US006244543B1

(12) United States Patent
Gugel et al.

(10) Patent No.: US 6,244,543 B1
(45) Date of Patent: Jun. 12, 2001

(54) MODEL RAILROAD TRACK SWITCH

(75) Inventors: Steven Gugel, Sykesville, MD (US); James J. Weaver, Dunellen, NJ (US); Timothy Edward White, Sykesville, MD (US)

(73) Assignee: Atlas O, LLC, Hillside, NJ (US)

( * ) Notice: Subject to any disclaimer, the term of this patent is extended or adjusted under 35 U.S.C. 154(b) by 0 days.

(21) Appl. No.: 09/437,074

(22) Filed: Nov. 9, 1999

(51) Int. Cl.[7] ..... E01B 7/00; E01B 25/06
(52) U.S. Cl. ..... 246/415 A; 104/130.01
(58) Field of Search ..... 104/130.01, 130.11, 104/DIG. 1; 246/415 R, 415 A, 435 R

(56) References Cited

PUBLICATIONS

Lionel, LLC, Chesterfield, Michigan, Catalog 1999, pp. 43–44.
MDK, Inc., Chapel Hill, NC, Catalog 1996, pp. 48–50.

*Primary Examiner*—S. Joseph Morano
*Assistant Examiner*—Robert J. McCarry, Jr.
(74) *Attorney, Agent, or Firm*—Leonard Bloom

(57) ABSTRACT

A switching device adapted to be used with a model railroad track which has a track switch. The switching device has a slide member connected to a pivot assembly. The pivot assembly is spring connected to a link member which moves a throw bar to move the track switch between a first position and a second position. The switching device may be operated manually and may be remotely operated electrically.

16 Claims, 7 Drawing Sheets

MODEL RAILROAD TRACK SWITCH

BACKGROUND OF THE INVENTION

1. Field of the Invention

The present invention relates to a track switch for a model railroad track and more particularly to a switch which has a spring to assist in the switching mechanism.

2. Description of the Related Art

Switches for model railroads are usually comparatively large, bulky devices which are connected to the track at a single predetermined location. The switches are electrically connected to the rail in the track and are activated when the model train approaches.

There is a need for a more compact, versatile switch.

BRIEF SUMMARY OF THE INVENTION

It is an object of the invention to provide a low profile switch device which does not interfere with the passage of model train equipment on the adjoining track.

It is another object of the invention to provide a switch device which is removably connected to an adjacent track at multiple positions and may be connected to either side of the track.

It is a further object of the invention to provide a switch with non-derailing action.

In accordance with the teachings of the present invention, there is disclosed a switching device adapted to be used with a model railroad track which has a track switch. The switching device has a base and a cover removably connected thereto. The base has a first portion and an adjoining second portion. A slide member is disposed in the base, the slide member being longitudinally slidable in the first portion of the base. The slide member has a slot formed diagonally therein. A hollow core is disposed in the second portion of the base longitudinally adjacent to the first portion of the base. The core has a first coil and a second coil of electrically conducting wire wound thereabout, the coils of wire being longitudinally juxtapositioned. A plunger rod is received in the hollow core, the plunger rod having a first end external of the core and a second end internal in the core. The first end of the plunger rod is connected to the slide member wherein longitudinal movement of the slide member within the base corresponds with longitudinal movement of the plunger within the core. A pivot assembly has a top and a spaced-apart bottom connected to one another. A pin is disposed between the top and the bottom, a spring attached to the pin. The pivot assembly has a first end and an opposite second end. The first end has a downward extending protrusion formed thereon, the protrusion being slidingly received in the diagonal slot in the sliding member. A link member is disposed in the base near the second end of the pivot assembly, and is connected to the spring in the pivot assembly. The link member extends outwardly from an opening in the base. The link member is connected to a throw bar disposed in the track, the throwbar being connected to the track switch. Means are provided for electrically energizing a selected one of the coils. Energization of one of the coils moves the first end of the plunger rod away from the core which moves the track switch to a first position and energization of the other of the coils moves the first end of the plunger rod toward the core which moves the track switch to a second position. The switching device has a low profile such that the switching device does not interface with model trains passing on the track.

In further accordance with the teaching of the present invention, there is disclosed a switching device adapted to be used with a model railroad track which has a track switch. The switching device has a base and a cover removably connected thereto. The cover has a longitudinal slot formed therein. A slide member is disposed in the base, the slide member being longitudinally slidable in a first portion of the base. The slide member has a pin connected to the slide member, the pin extending upwardly from the slide member and being received in the longitudinal slot in the cover. The slide member further is connected to a throwbar, the throwbar being connected to the track switch. Longitudinal movement of the pin within the slot produces concomitant movement of the slide member within the base to move the throwbar and the track switch.

In still further accordance with the teachings of the present invention, there is disclosed a switching device adapted to be used with a model railroad track which has a track switch. The device has a base with a cover removably connected thereto. A pivot assembly has a top and a spaced-apart bottom connected to one another. A pin is disposed between the top and the bottom. A spring is attached to the pin. The pivot assembly is slidably disposed in the base. A link member is disposed in the base and connected to the spring in the pivot assembly, the link member extending outwardly from an opening in the base. The link member is connected to a throwbar disposed in the track, the throwbar being connected to the track switch. Sliding movement of the pivot assembly away from the link member extends the spring and moves the track switch in one direction and sliding movement of the pivot assembly toward the link member compresses the spring and moves the back switch in an opposite direction.

These and other objects of the present invention will become apparent from a reading of the following specification taken in conjunction with the enclosed drawings.

DESCRIPTION OF THE PREFERRED EMBODIMENTS

Referring now to FIGS. 1–5, the present invention is a switching device 10 to operate and control track switches (turnouts) 12 for a three rail O gauge model railroad. The track switch 12 is a movable portion of the track which is pivotable about a point such that the wheels of the train may be guided to a selected set of tracks where two sections of track are joined to provide alternate routing of the train.

Figure 6:
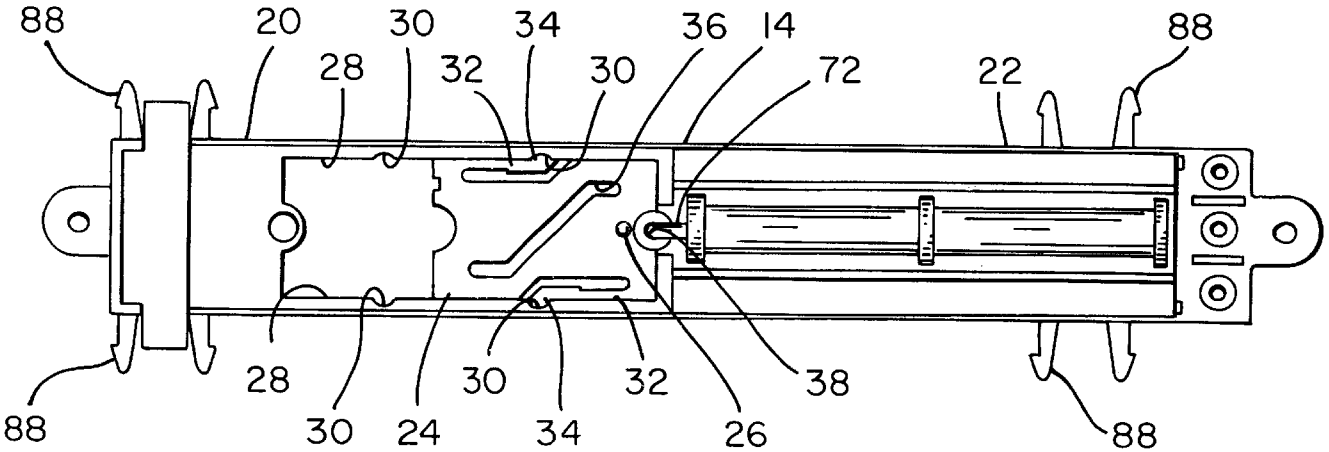
FIG. 6 is a top plan view of the base with the cover and pivot assembly removed and the slide member being disposed near the coil.
Figure 7:
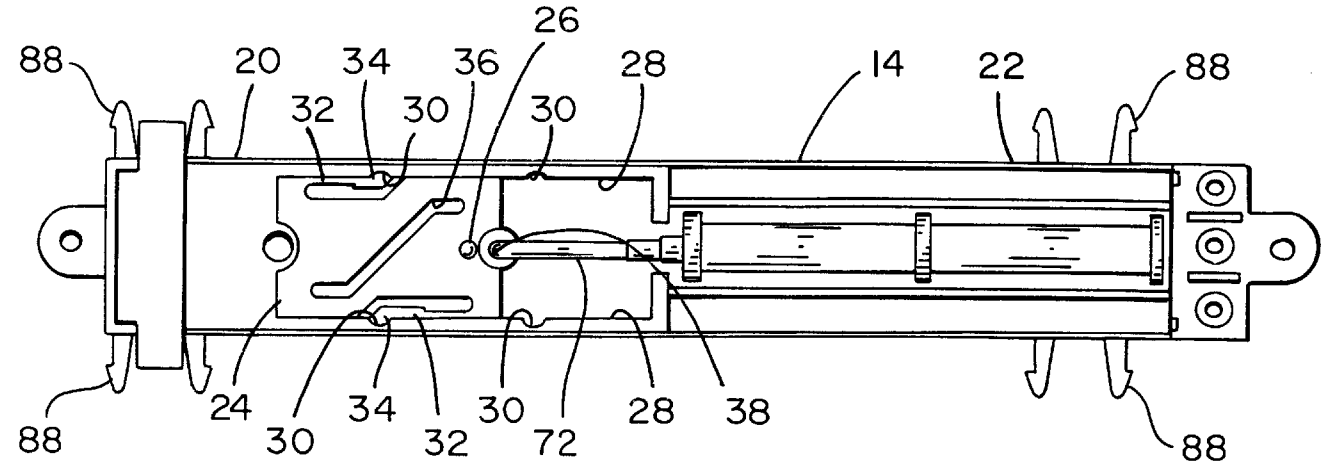
FIG. 7 is a top plan view of the base with the cover and pivot assembly removed and the slide member being disposed distal from the coil.
Figure 8:
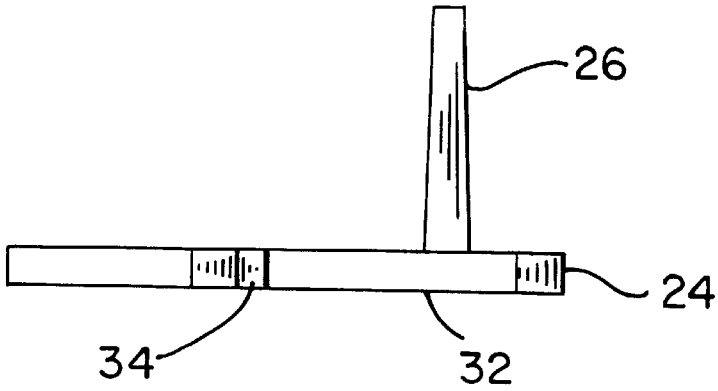
FIG. 8 is a side elevation view of the slide member.

The switching device 10 has a base 14 and a cover 16 which is removably connected to the base 10, preferably by a snap friction fit. The cover 16 has a longitudinal slot 18 formed in an upper surface thereof. The base 10 has a first portion 20 and a longitudinally adjacent second portion 22. A slide member 24 is disposed in the first portion 20 of the base 10. The slide member 24 is longitudinally slidable within the first portion of the base as will be described (FIGS. 6 and 7). A pin 26 is connected to the slide member 24 and extends upwardly from the slide member. When the cover 16 is connected to the base 18, the pin 26 is received in the longitudinal slot 18 in the cover 16. Longitudinal movement of the pin 26 within the slot 18 produces concomitant movement of the slide member 24 within the base 14.

The first portion of the base 14 has a right and a left inner sidewall 28. A pair of spaced-apart notches 30 are formed in each inner sidewall 28. The slide member 24 has two resilient legs 32 formed thereon. Each leg has a protrusion 34 formed at approximately the respective end of each leg 32. The protrusions 34 extend outwardly from the slide member 24. Preferably, each leg 32 has a channel formed between the respective leg and the slide member. Each leg is connected to the slide member at the end of the channel distal from the protrusion. When the slide member 24 is moved longitudinally in a first direction within the first portion 20 of the base 14, the legs flex and the protrusion 34 on the right leg 32 of the slide member 24 engages one of the notches 30 on the right inner sidewall 28 of the base 14 and the protrusion 34 on the left leg 32 of the slide member 24 engages a corresponding notch 30 on the left inner sidewall 28 of the base 14 to retain the slide member 24 in a selected position within the first portion of the base. Longitudinal movement of the slide member 24 in a second opposite direction disengages the respective protrusions from the one set of notches 30 and engages the respective protrusions 34 in the spaced-apart other notches 30 on the right and left inner sidewalls 28 of the base 14 (FIGS. 6 and 7). Thus, the slide member 24 is slidable between a first position proximal to the second portion 22 of the base and a second position distal from the second portion 22 of the base. In either position, the slide member 24 is retained in the selected position but may be moved to the other position.

The slide member 24 further has a slot 36 formed diagonally therein. The slide member 24 also has a bore 38 formed at the approximate midpoint of the end of the slide member proximal to the second portion 22 of the base 14. The function of the diagonal slot 36 and the bore 38 will be described.

Figure 9:
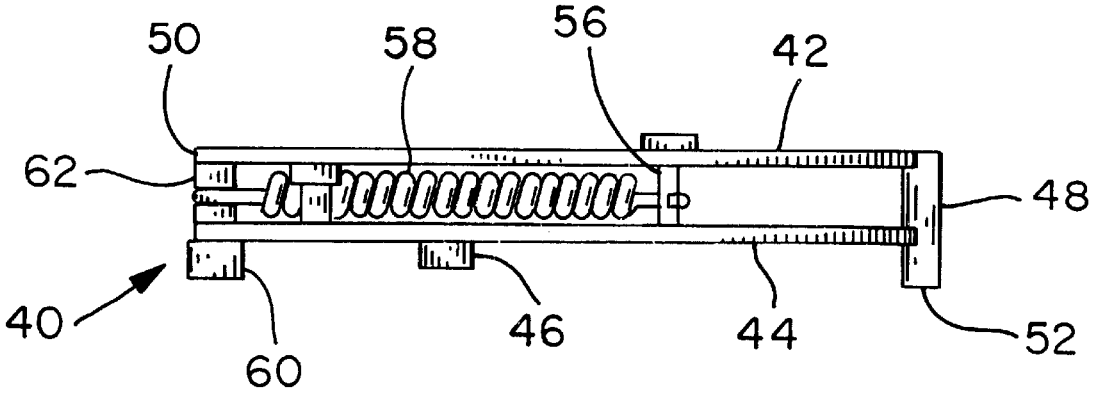
FIG. 9 is a side elevation view of the pivot assembly connected by a spring to the link member.

A pivot assembly 40 has a top 42 and a bottom 44 which are spaced apart and removably connected to one another. Preferably, the under surface of the bottom 44 has a pivot means 46 formed therein which is pivotally connected to the base 14 of the device at a point distal from the second portion 22 of the base (FIG. 9). The pivot assembly 40 has a first end 48 and an opposite second end 50. A downward extending protrusion 52 is formed on the first end 48 of the pivot assembly 40. A plurality of spaced-apart locator openings 54 are formed linearly in the top 42 and bottom 44 of the pivot assembly 40 between the first end 48 and the second end 50. The locator openings in the top and bottom are directly opposed. It is preferred that six locator openings 54 be formed but this number is not critical. A pin 56 is disposed in a selected locator opening 54 between the top 42 and the bottom 44. A spring 58 is attached to the pin 56 and is directed to the second end 50 of the pivot assembly 40.

The pivot assembly 40 is disposed in the first portion 20 of the base 14 with protrusion 52 slidably received in the diagonal slot 36 in the slide member 26.

Figure 5:
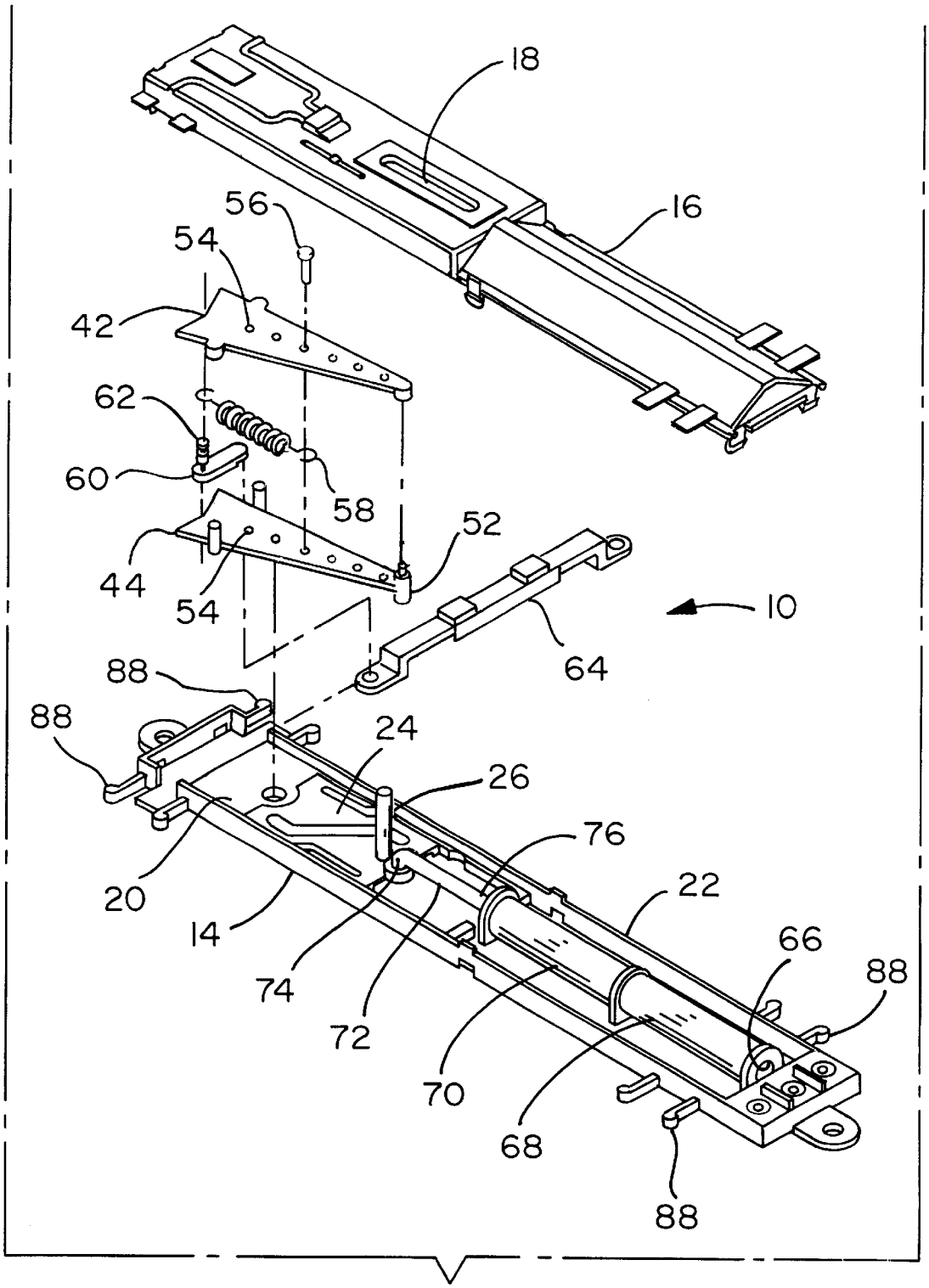
FIG. 5 is an exploded view of the switching device.
Figure 10:
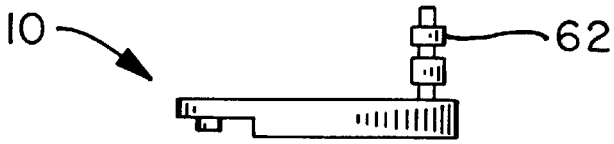
FIG. 10 is a side elevation view of the link member.

As shown in FIGS. 5 and 10, a link member 60 is disposed in the base 14 distal from the second portion 22 and near the second end 50 of the pivot assembly 40. The link member 60 has an upward extending post 62 which is connected to the spring 58 extending outwardly from the pin 56 in the pivot assembly 40. The link member 60 extends outwardly through an opening in the base 14 and is pivotally connected to a throwbar 64. The throwbar 64 is slidably disposed in the track section connected to the track switch 12 as will be described.

The tension applied to the link member 60 and the throwbar 64 is adjustable depending upon the disposition of the pin 56 in a selected pair of locator openings 54. As the pin 56 is moved to locator openings 54 closer to the first end 48 of the pivot assembly 40, the spring 58 is extended and increased tension is applied to the link member 60 and throwbar 64. To change the tension, the pin 56 is withdrawn from the locator openings 54 and moved to another set of locator openings with the spring connected to the pin 56 in the changed location. The spring 58 is reattached to the link member 60.

Figure 11:
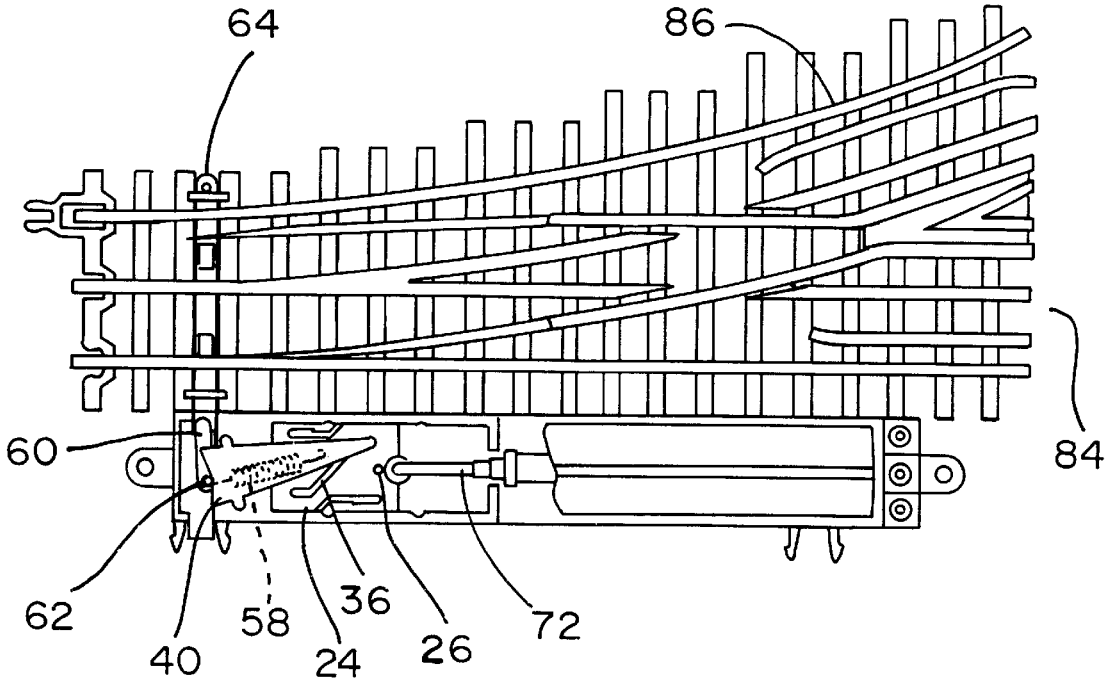
FIGS. 11–12 are top plan views with the cover removed showing manual switching.

The movable rails of the track switch 12 may be operated manually by moving the pin 26 which extends out of the slot 18 in the cover 16. Sliding the pin 26 in a direction away from the second portion 22 of the base 14 produces concomitant sliding of the slide member 24 within the base 14 (FIG. 11). As the slide member 24 moves, the pivot assembly 40 pivots about the pivot means 46 and the protrusion 52 on the first end 48 of the pivot assembly follows the diagonal slot 36 in the slide member 24 toward the second portion of the base. The second end 50 of the pivot assembly is directed away from the track switch 12. The spring 58 urges the link member 60 away from the track switch 12 and the link member 60 moves the throwbar 64 toward the switching device 10 and throws the track switch 12 to a first selected position. It is preferred that this first position provides a track rail configuration which directs the train from the side track 86 to enter the main track 84.

Figure 12:
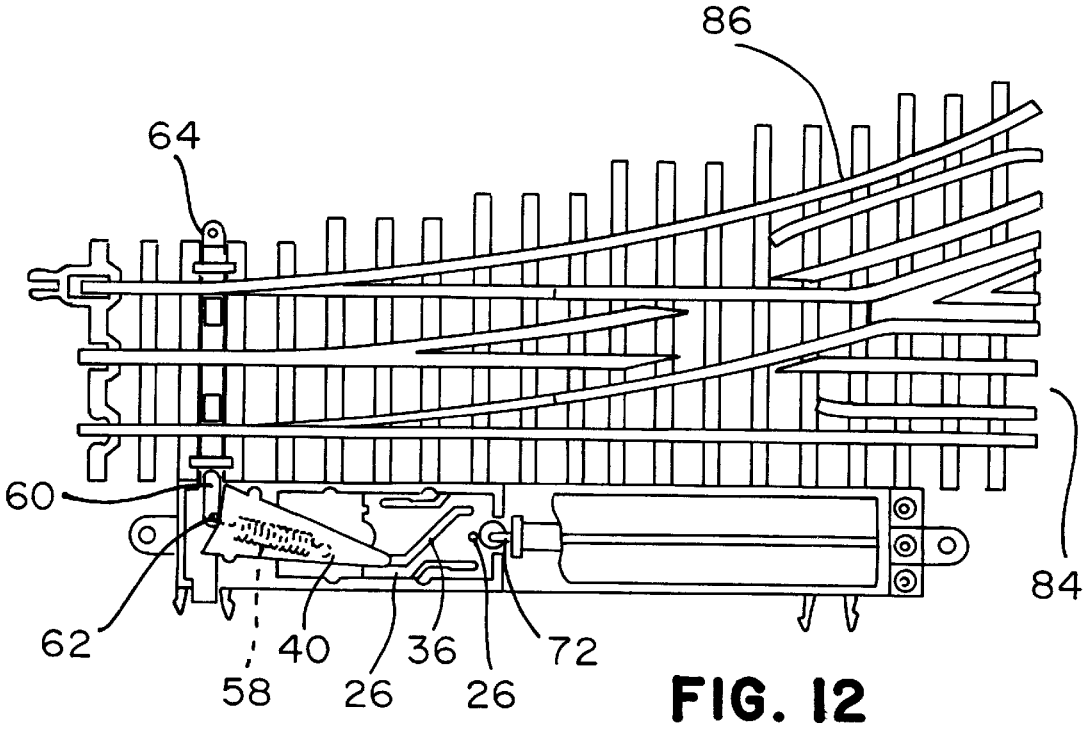
Figure 13:
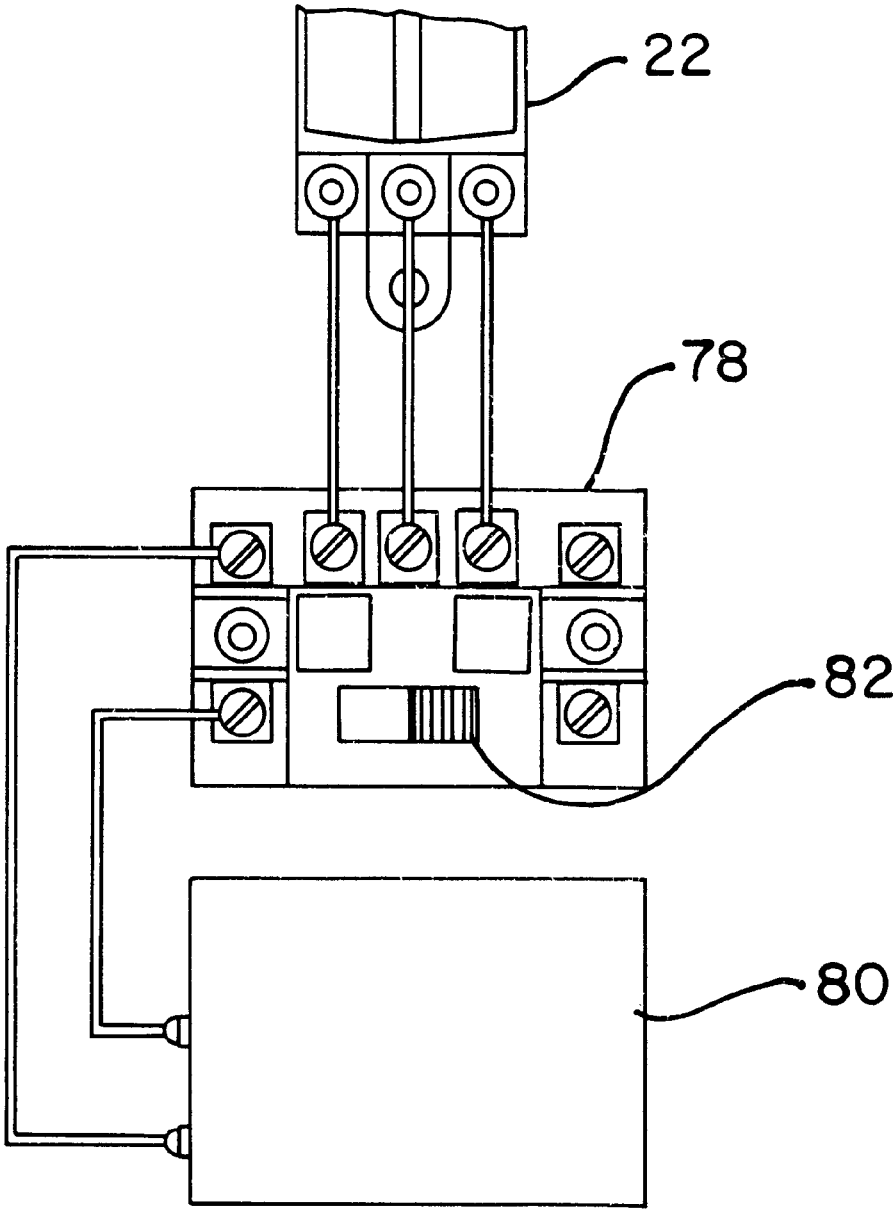
FIG. 13 is a diagrammatic view of the electrical connection of the momentary contact switch to the switching device.

When the pin 20 is slid in a direction toward the second portion 22 of the base 14, as in FIG. 12, the slide member 24 is similarly moved within the base 14. The pivot assembly 40 pivots about the pivot means 46 and the protrusion 52 on the first end 48 of the pivot assembly follows the diagonal slot 36 away from the second portion of the base. The second end 50 of the pivot assembly is directed toward the track switch 12. The spring 58 urges the link member 60 toward the track switch 12 and the link member 60 moves the throwbar 64 away from the switching device and throws the track switch 12 to a second selected position. It is preferred that this second position provides a track rail configuration which directs the train in a straight course through the track intersection.

The incorporation of the spring 58 in the switching mechanism provides a non-derailing action to the track switch 12. In the event that a train is on the side track 86 and is approaching the intersection with the main track 84, and the track switch 12 is in the second selected position, the rail configuration would prevent the train from proceeding through the intersection and the train would derail. However, because the track switch 12 is urged into the second position due to the spring 58, the track switch 12 will act against the urging of the spring 58 when the train encounters the rail and the track switch 12 will open sufficiently to allow the train to continue through the intersection without derailing.

As noted above, the pivot assembly 40 has a pin 56 to which the spring 58 is attached and the pin 56 may be disposed in any of a plurality of locator openings 54. The disposition of the pin 56 affects the tension on the spring 58. Thus, the operator of the model railroad can adjust the spring tension by moving the pin 56 and can, therefore, adjust the force with which the spring urges the track switch 12 to the selected positions.

The track switch 12 may also be operated electrically.

A hollow core 66 is disposed in the second portion 22 of the base 14. The hollow core 66 is longitudinally adjacent to the first portion 20 of the base 14. Wound about the core 66 is a first coil 68 and a second coil 70 of electrically conducting wire. The coils 68, 70 are longitudinally juxtapositioned with respect to one another. Electrical leads from the coils are electrically connected to three (3) terminals on the end of the second portion 22 of the base 14. A plunger rod 72 is received in the hollow core 66. The plunger rod 72 has a first end 74 external of the core 66 and a second opposite end 76, internal in the core 66. The first end 74 of the plunger rod 72 is connected to the end of the slide member 24 proximal to the second portion 22 of the base 14. In this manner, longitudinal movement of the slide member 24 within the base 14 corresponds with longitudinal movement of the plunger rod 72 within the core 66 (FIGS. 6, 7, 11 and 12). As the slide member 24 moves away from the second portion 22 of the base 14, the plunger rod 72 is partially withdrawn from the core 66. As the slide member moves toward the second portion 22 of the core 66, the plunger rod 72 is inserted further into the core 66. Also, as noted above, movement of the slide member 24 produces movement of the track switch 12. Thus, partial withdrawal of the plunger rod 72 (FIG. 11) produces the first selected position of the track switch. When the plunger rod 72 is inserted into the core 66 (FIG. 12), the slide member 24 is proximal to the second portion 22 of the base 14 and the track switch is in the second selected position.

The three terminals on the end of the second portion 22 of the base 14 are electrically connected to a remotely located switch control box 78 which is connected to an electrically powered transformer 80. A momentary contact switch 82 is mounted in the switch control box 78. The mounting contact switch 82 is slidable between a left position and a right position. Activation of the momentary contact switch 82 in the left position by applying downward pressure completes the electrical circuit and provides a burst of energy to a selected coil 68, 70. Sliding of the momentary contact switch 82 to the right and activation by downward pressure provides a burst of energy to the other selected coil 68, 70. The electrical wiring determines which coil 68, 70 is energized. When either coil 68, 70 is activated, the coil acts as a solenoid and moves the plunger rod 72 within the core 66 to either the partially withdrawn or the inserted position. In this manner, the operator can positively switch the track switch 12 between the first selected position and the second selected position by selecting the right or left position of the momentary contact switch 82 and pressing on the switch.

Figure 1:
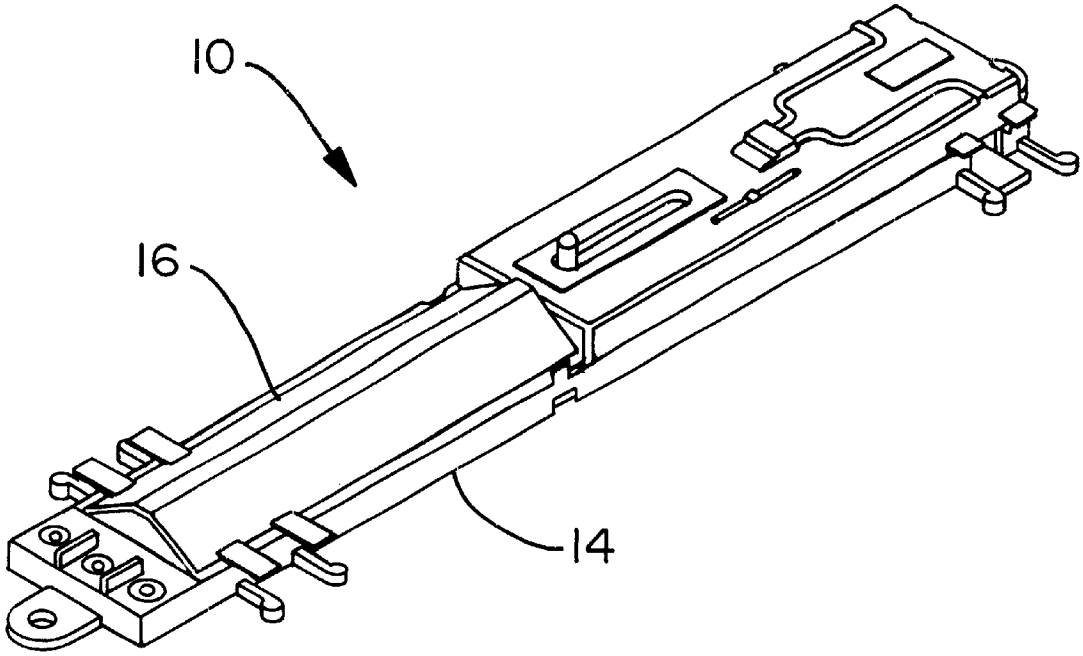
FIG. 1 is a perspective view of the switching device of the present invention.
Figure 2:
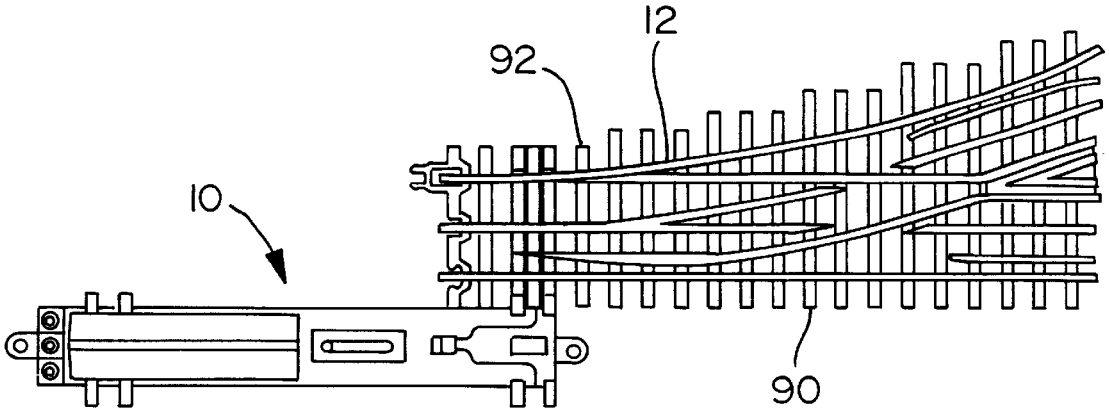
FIG. 2 is a top plan view of the switching device in a first connection to the track.
Figure 3:
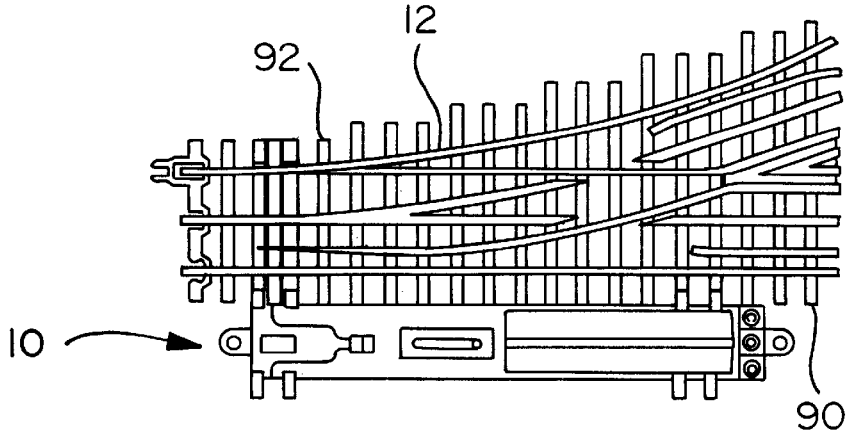
FIG. 3 is a top plan view of the switching device in a second connection to the track.
Figure 4:
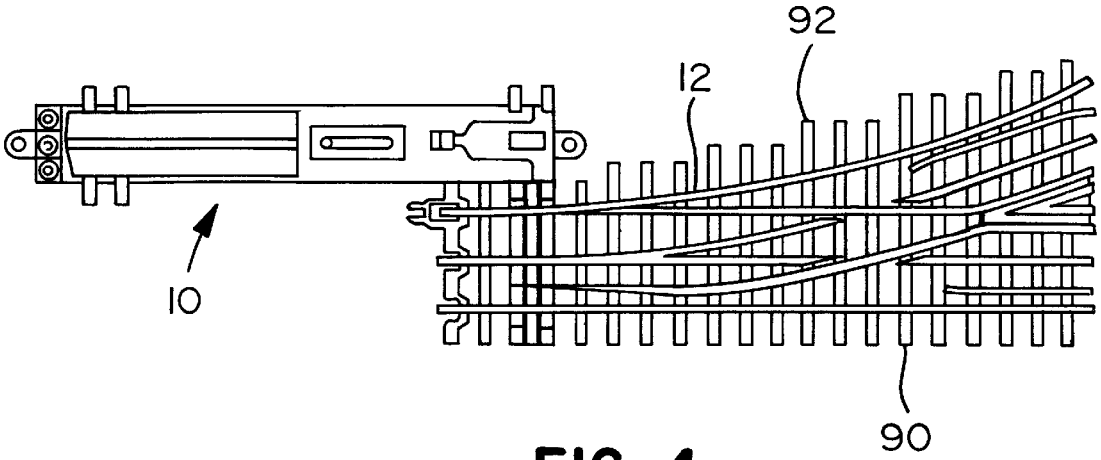
FIG. 4 is a top plan view of the switching device in a third connection to the track.

The switching device 10 has interlocks 88 extending outwardly from both sides of the switching device which are received in cooperating interlocks formed as part of the tie strip on the adjacent track section. Preferably male interlocks are formed on the switching device 10 and female interlocks are formed on the tiestrip but these could be reversed. The interlocks 88 on the switching device 10 are formed near both ends and on both sides. This provides a versatility in the connection of the switching device 10 to the track section as shown in FIGS. 2, 3 and 4. These figures show the track section having a first side 90 and a second side 92 with the track switch 12 therebetween. The interlocks 88 on the switching device 10 may be removably connected to cooperating interlocks on the first side 90 of the track with the end containing the coils 68, 70 oriented toward the left or the right. Also, the switching device 10 may be removably connected to the second side 92 of the track. The placement of the switching device 10 is dependent upon the available space and the desires of the operator of the model railroad. Multiple positioning of the switch is provided.

The switching device 10 has a low profile such that when disposed adjacent to the track section, the switching device does not interfere with the model trains passing by on the track.

Also, the switching device 10 can be used with track sections made by different manufacturers and is not limited to track provided by only one supplier. The link member 60 may be different in shape or configuration to adapt the switching device 10 to the throwbar 64 depending upon the supplier of the track section.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A switching device adapted to be used with a model railroad track which has a track switch, the switching device comprising:

a base and a cover removably connected thereto, the base having a first portion and an adjoining second portion, a slide member disposed in the base, the slide member being longitudinally slidable in the first portion of the base, the slide member having a slot formed diagonally therein, a hollow core disposed in the second portion of the base longitudinally adjacent to the first portion of the base, the core having a first coil and a second coil of electrically conducting wire wound thereabout, the coils of wire being longitudinally juxtapositioned, a plunger rod being received in the hollow core, the plunger rod having a first end, external of the core and a second end internal in the core, the first end of the plunger rod being connected to the slide member wherein longitudinal movement of the slide member within the base corresponds with longitudinal movement of the plunger within the core, a pivot assembly having a top and a spaced-apart bottom connected to one another, a pin disposed between the top and the bottom, a spring attached to the pin, the pivot assembly having a first end and an opposite second end, the first end having a downward extending protrusion formed thereon, the protrusion being slidingly received in the diagonal slot in the sliding member, a link member disposed in the base near the second end of the pivot assembly, and connected to the spring in the pivot assembly, the link member extending outwardly from an opening on the base, the link member being connected to a throwbar disposed in the track, the throwbar being connected to the track switch, means for electrically energizing a selected one of the coils, wherein energization of one of the coils moves the first end of the plunger rod away from the core which moves the track switch to a first position and energization of the other of the coils moves the first end of the plunger rod toward the core which moves the track switch to a second position, the switching device having a low profile such that the switching device does not interfere with model trains passing on the track.

2. The switching device of claim 1, further comprising the base having a right and a left inner sidewall, a pair of spaced-apart notches being formed in each sidewall, the slide member having two resilient legs formed thereon, a right leg and a left leg, each leg having a protrusion formed thereon, wherein when the slide member is moved longitudinally in a first direction, the protrusion on the right leg of the slide member engages one of the notches on the right inner wall of the base and the protrusion on the left leg of the slide member engages a corresponding notch on the left inner wall of the base and longitudinal movement of the slide member in the opposite second direction engages the respective protrusions on the right and left legs of the slide member with the spaced-apart other notches on the sidewalls of the base.

3. The switching device of claim 1, wherein means are formed on the switch device to removably connect the switch device to the track.

4. The switching device of claim 3, wherein the base of the device has an interlock formed thereon, the interlock cooperating with a cooperating interlock formed in a side of the track.

5. The switching device of claim 3, wherein the track has a first side and an opposite second side with the track switch therebetween, the switch device being adapted to be connected to either side of the track.

6. The switching device of claim 1, wherein the top and bottom of the pivot assembly are removably connected, the top and the bottom each having a plurality of spaced-apart locator openings formed linearly therein, between a first end and a second end of the pivot assembly, the locator openings on the top and bottom being directly opposed, wherein the pin in the pivot assembly may be disposed in a selected locator opening in the top and a corresponding opposed locator opening in the bottom such that increased tension is produced on the spring as the pin is moved distally from the link member.

7. The switching device of claim 1, further comprising a pin connected to the slide member extending upwardly from the slide member, the cover having a longitudinal slot formed therein, the pin being received in the longitudinal slot such that longitudinal movement of the pin produces concomitant movement of the slide member in the base, wherein the track switch may be disposed in a selected position by manual movement of the pin within the slot.

8. The switching device of claim 1, further comprising a momentary contact switch electrically connected to the first and second coils and disposed remotely from the switch device, the momentary contact switch being slidable between a left and a right position, such that activation of the momentary contact switch in the left position provides a burst of power energizing one of the coils, moving the plunger rod and the slide member to produce a first setting of the track switch and activation of the momentary contact switch in the right position provides a burst of power energizing the other of the coils, moving the plunger rod and the slide member to produce a second setting of the track switch.

9. A switching device adapted to be used with a model railroad track which has a track switch, the switching device comprising:

a base and a cover removably connected thereto, the cover having a longitudinal slot formed therein, a slide member disposed in the base, the slide member being longitudinally slidable in a first portion of the base, the slide member having a pin connected to the slide member, the pin extending upwardly from the slide member and being received in the longitudinal slot in the cover, the slide member further being connected to a throwbar, the throwbar being connected to the track switch, such that longitudinal movement of the pin within the slot produces concomitant movement of the slide member within the base to move the throwbar and the track switch.

10. The switching device of claim 9, further comprising the base having a right and a left inner sidewall, a pair of spaced-apart notches being formed in each sidewall, the slide member having two resilient legs formed thereon, a right leg and a left leg, each leg having a protrusion formed thereon, wherein when the slide member is moved longitudinally in a first direction, the protrusion on the right leg of the slide member engages one of the notches on the right inner wall of the base and the protrusion on the left leg of the slide member engages a corresponding notch on the left inner wall of the base and longitudinal movement of the slide member in the opposite second direction engages the respective protrusions on the right and left legs of the slide member with the spaced apart other notches on the sidewalls of the base.

11. The switching device of claim 10, wherein the pivot assembly is moved electrically.

12. The switching device of claim 11, further comprising the base having a first portion and an adjoining second portion, a slide member disposed in the first portion of the base and being longitudinally slidable therein, the pivot assembly being pivotally connected to the slide member, a hollow core disposed in the second portion of the base longitudinally adjacent to the first portion of the base, the core having a first coil and a second coil of electrically conducting wire wound thereabout, the coils of wire being longitudinally juxtapositioned, a plunger rod being received in the hollow core, the plunger rod having a first end external of the core and a second end internal in the core, the first end of the plunger rod being connected to the slide member wherein longitudinal movement of the slide member moves the plunger rod longitudinally within the core, a momentary contact switch electrically connected to the coils and disposed remotely from the switch device, a power supply electrically connected to the momentary contact switch the momentary contact switch being slidable between a left and a right position, such that activation of the momentary contact switch in the left position provides a burst of power energizing one of the coils, moving the plunger rod, the slide member and the pivot assembly to produce a first setting of the track switch and activation of the momentary contact switch in the right position provides a burst of power energizing the other of the coils, moving the plunger rod, the slide member and the pivot assembly to produce a second setting of the track switch.

13. A switching device adapted to be used with a model railroad track which has a track switch, the device comprising:

a base with a cover removably connected thereto, a pivot assembly having a top and a spaced-apart bottom connected to one another, a pin disposed between the top and the bottom, a spring attached to the pin, the pivot assembly being slidably disposed in the base, a link member disposed in the base and connected to the spring in the pivot assembly, the link member extending outwardly from an opening in the base, the link member being connected to a throwbar disposed in the track, the throwbar being connected to the track switch, wherein sliding movement of the pivot assembly away from the link member extends the spring and moves the track switch in one direction and sliding movement of the pivot assembly toward the link member compresses the spring and moves the track switch in an opposite direction.

14. The switching device of claim 13, wherein the top and bottom of the pivot assembly are removably connected, the top and the bottom each having a plurality of spaced-apart locator openings formed linearly therein, between a first end and a second end of the pivot assembly, the locator openings on the top and bottom being directly opposed, wherein the pin in the pivot assembly may be disposed in a selected locator opening in the top and a corresponding opposed locator opening in the bottom such that increased tension is produced on the spring as the pin is moved distally from the link member.

15. The switching device of claim 13, wherein the pivot assembly is moved manually.

16. The switching device of claim 15, further comprising the cover having a longitudinal slot formed therein, the pivot assembly being pivotally connected to a slide member, the slide member being slidably movable within the base, a pin connected to the slide member and extending upwardly therefrom, the pin being received in the longitudinal slot in the cover, such that manual longitudinal movement of the pin within the slot produces concomitant movement of the slide member within the base and pivotal movement of the pivot assembly.

* * * * *